US008870718B2

(12) United States Patent
Habing

(10) Patent No.: US 8,870,718 B2
(45) **Date of Patent: *Oct. 28, 2014**

(54) FLEXIBLE SHROUD FOR EXERCISE EQUIPMENT

(71) Applicant: Dream Visions, LLC, Tustin, CA (US)

(72) Inventor: Theodore G. Habing, Tustin, CA (US)

(73) Assignee: Dream Visions, LLC, Tustin, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/975,018

(22) Filed: Aug. 23, 2013

(65) Prior Publication Data

US 2013/0345030 A1 Dec. 26, 2013

Related U.S. Application Data

(63) Continuation of application No. 11/002,805, filed on Dec. 1, 2004, now Pat. No. 7,837,600.

(51) Int. Cl.

| | |
|---|---|
| ***A63B 21/00*** | (2006.01) |
| ***A63B 21/06*** | (2006.01) |
| ***A63B 71/00*** | (2006.01) |
| *A63B 21/062* | (2006.01) |

(52) U.S. Cl.

CPC ..... *A63B 21/0618* (2013.01); *A63B 71/0054* (2013.01); *A63B 21/062* (2013.01); *A63B 2071/009* (2013.01)

USPC ..... 482/93; 482/98; 482/99

(58) Field of Classification Search

USPC ..... 482/93, 94, 95, 96, 97, 98

See application file for complete search history.

(56) References Cited

U.S. PATENT DOCUMENTS

| | | | | |
|---|---|---|---|---|
| 4,433,868 | A * | 2/1984 | Hochwitz et al. | 296/79 |
| 4,809,973 | A | 3/1989 | Johns | |
| 5,054,773 | A | 10/1991 | Parviainen | |
| 5,429,562 | A | 7/1995 | Milner | |
| 5,491,843 | A * | 2/1996 | Naughton | 2/48 |
| 5,790,992 | A * | 8/1998 | Ray | 4/599 |
| 5,890,507 | A * | 4/1999 | Hinsperger | 135/96 |
| 5,892,507 | A | 4/1999 | Moorby | |
| 5,920,927 | A | 7/1999 | Thomas | |
| 5,951,257 | A * | 9/1999 | Matson | 416/246 |
| 6,102,835 | A | 8/2000 | Webber | |
| 6,745,414 | B2 | 6/2004 | Zhou | |
| 7,231,673 | B1 | 6/2007 | Arnold et al. | |
| 2007/0173384 | A1 | 7/2007 | Sechrest et al. | |

* cited by examiner

*Primary Examiner* — Jerome W Donnelly

(74) *Attorney, Agent, or Firm* — Blakely Sokoloff Taylor & Zafman LLP

(57) ABSTRACT

A flexible shroud is used to cover weights and hide pulleys and cables on exercise machines. The flexible shroud can be a coarse mesh or screen for see through areas, cloth such as canvas or other fabrics, or other flexible sound absorbing materials. The material may be supported around or between a framework of ribs, poles, or metal screen and takes the shape of the framework. The material may also be supported only at the top and bottom of a weight stack or structure by a rigid template from which the material takes shape. The top or bottom support may be adjusted to stretch the fabric taut so it takes shape better and tightens to provide a better safety shield. The material may be attached to the supports or framework by snaps, hook and loop material, or other removable fasteners.

24 Claims, 4 Drawing Sheets

FLEXIBLE SHROUD FOR EXERCISE EQUIPMENT

CROSS-REFERENCE TO RELATED APPLICATION

This is a continuation application of co-pending application Ser. No. 11/002,805 filed Dec. 1, 2004.

BACKGROUND OF THE INVENTION

1. Field of the Invention

This invention relates to the field of exercise equipment, and particularly to lightweight, quiet, low cost safety and cosmetic covers for weight stacks and other exercise machine components.

2. Background

Exercise machines are sometimes fitted with shrouds to visually hide the machine's weight stack or other moving parts. Typical shrouds for weight stacks and exercise machine frames consist of sheet metal or rigid plastic. These rigid materials are often formed to fit around a weight stack or framework and require large protective boxes to ship them. They tend to form a sound box around the frame or the weight stack, amplifying the sound when operating a machine's weight stack or the moving parts on an aerobic machine. Shrouds of this type are shown, for example, in U.S. Pat. No. 6,102,835.

SUMMARY OF THE INVENTION

A flexible shroud is used to cover weights and hide pulleys and cables on exercise machines. The flexible shroud can be a coarse mesh or screen for see through areas, cloth such as canvas or other fabrics, or other flexible sound absorbing materials. The material may be supported around or between a framework of ribs, poles, or metal screen and takes the shape of the framework. The material may also be supported only at the top and bottom of a weight stack or structure by a rigid template from which the material takes shape. The top or bottom support may be adjusted to stretch the fabric taut so it takes shape better and tightens to provide a better safety shield. The material may be attached to the supports or framework by snaps, hook and loop material, or other removable fasteners.

Some of the advantages of flexible shrouds are:

1. Lightweight, small package easy to ship;
2. Low cost to produce;
3. Many color options;
4. Safety from pinching fingers/hands;
5. Fabric takes the shape of the template or framework to which it is attached;
6. Quieter than rigid metal and plastic shrouds;
7. Able to do custom embroidered logos on shrouds inexpensively.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
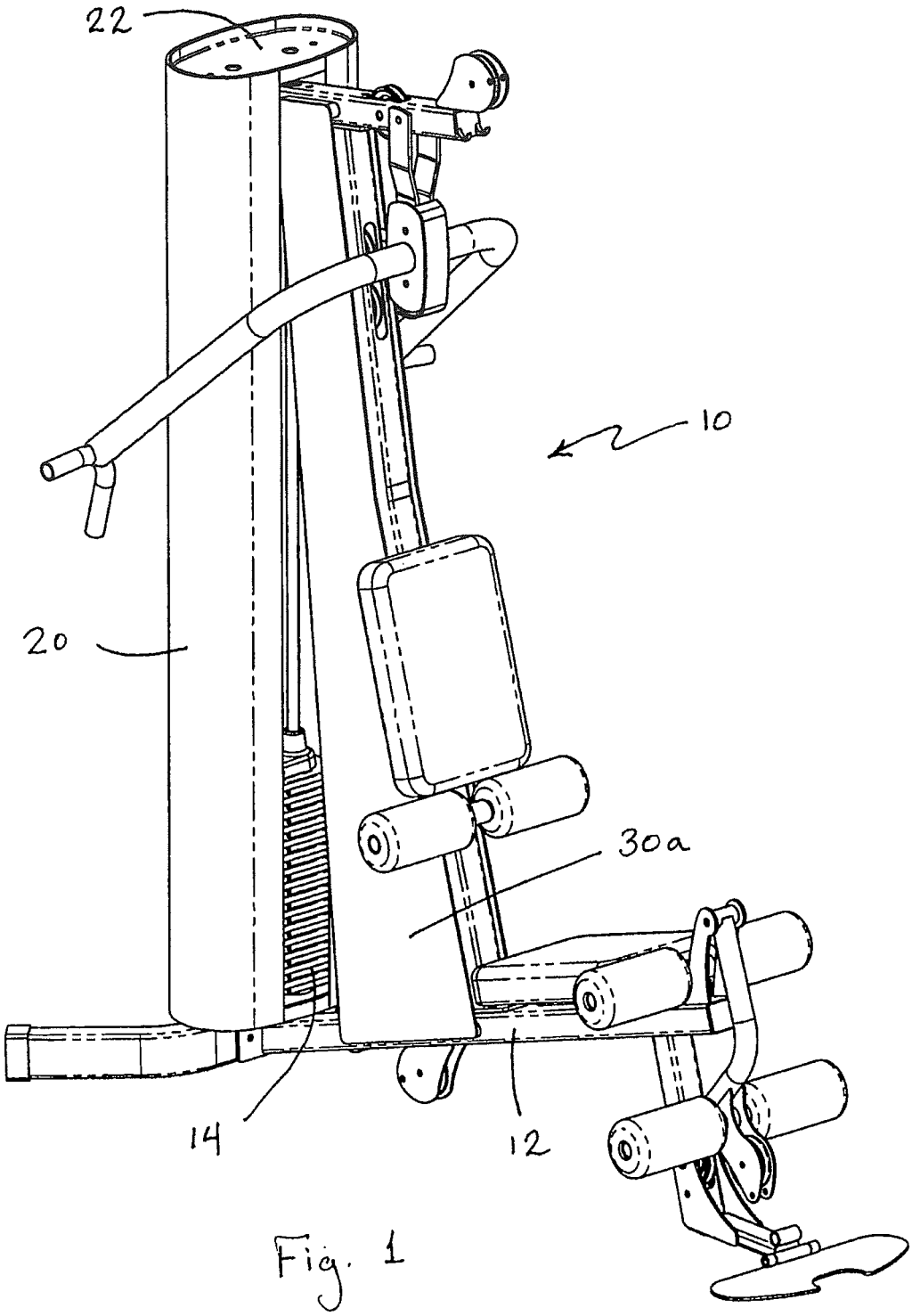
FIG. 1 illustrates an exercise machine with a flexible shroud in accordance with an embodiment of the present invention.

FIG. 1 shows an exercise machine 10 employing flexible shrouds in accordance with the present invention. Except for the shrouds, machine 10 is constructed in a conventional manner. A structural support frame 12 is fabricated of steel tubing. Machine 10 has a weight stack 14 for providing exercise resistance; however, it is to be understood that flexible shrouds in accordance with the present invention may also be applied to exercise devices that employ other forms of exercise resistance and also to equipment that does not necessarily have a provision for exercise resistance.

Flexible shroud 20 surrounds most of weight stack 14 to hide it from view. The shape of the shroud conforms to the contour of template member 22. As shown, template member 22 has a generally oval shape, but it could just as well be rectangular or any other arbitrary shape. Shroud 20 does not fully enclose weight stack 14 so that an operator can easily access a weight selector (not shown) to adjust the amount of exercise resistance. Flexible shroud 30*a* covers moving cables and pulleys of exercise machine 10. The flexible shrouds not only give machine 10 a more pleasing appearance, but also protect the operator and other persons from injuries due to contact with the moving parts of the machine.

Figure 2:
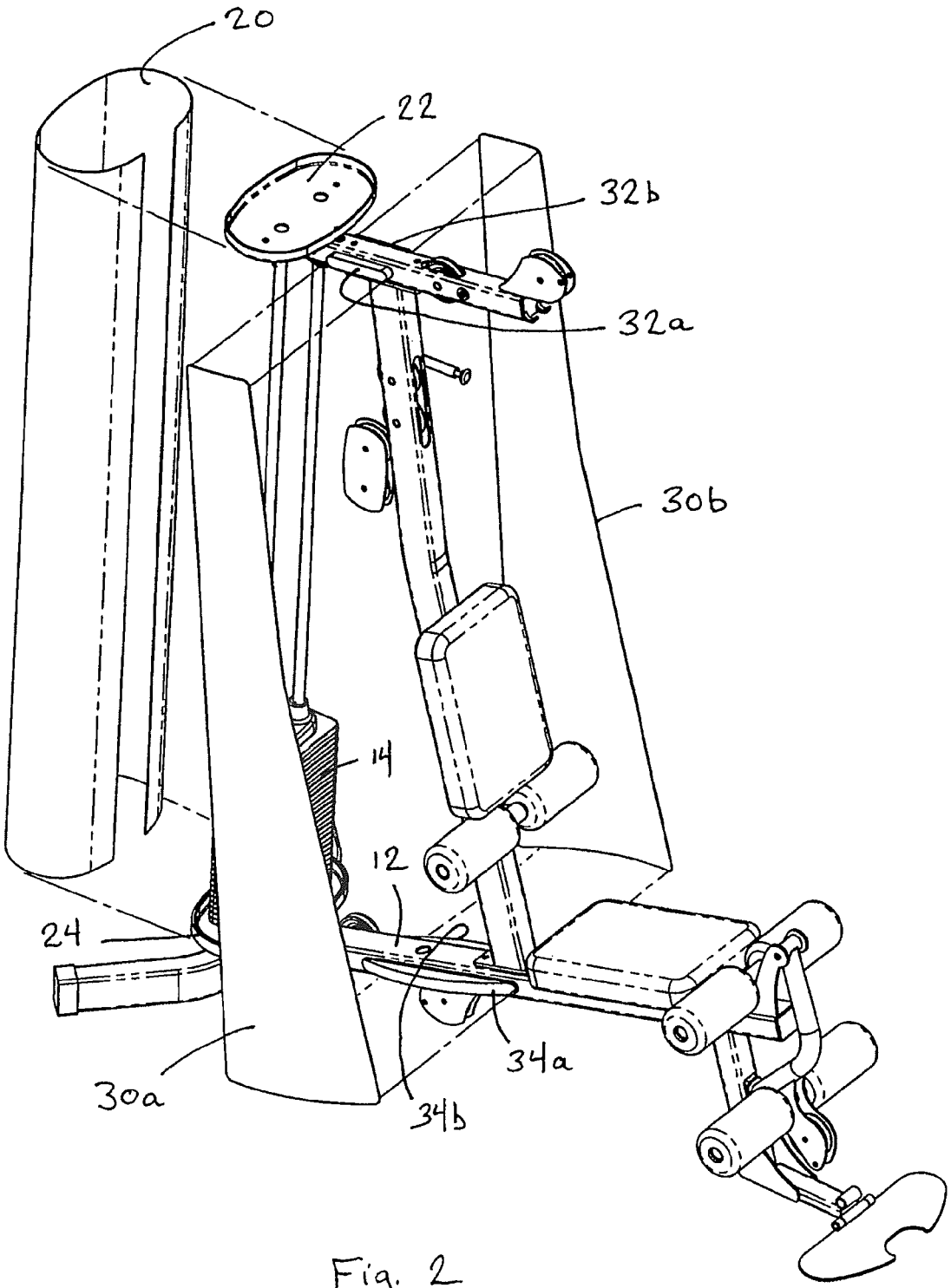
FIG. 2 is an exploded view of the exercise machine shown in FIG. 1.

FIG. 2 is an exploded view of exercise machine 10 showing the flexible shrouds removed therefrom. As mentioned above, shroud 20 attaches to an upper template member 22, which is secured to the frame 12 of the machine. Shroud 20 also attaches to a lower template member 24. One or both of the template members may be made vertically adjustable so that, once the shroud 20 has been attached, it may be drawn taut between the two template members. Shrouds 30*a* and 30*b* are likewise attached to upper and lower template members 32*a, b* and 34*a, b* respectively.

The shrouds are preferably attached to the respective template members so that they can be easily released therefrom for maintenance of machine 10 and for cleaning and replacement of the shrouds. The shrouds may be secured to the template members by snaps, by mating portions of hook and loop material, such as that marketed under the trademark VELCRO®, or by other suitable releasable fasteners.

Various materials may be used for the flexible shrouds. A droopy or "limp" material (i.e., a material that is not self-supporting), such as a fabric of natural or synthetic fibers, is particularly suitable since it easily conforms to the contours of the template members, is light in weight and low in cost. Shrouds of such material may be rolled and/or folded into a compact shape for shipping and storage. Fabric shrouds may be made in various colors and designs and may be imprinted with logotypes of the equipment manufacturer. Shrouds may be opaque or may be made of a see-through mesh or screen material. The appearance of an exercise machine may be easily customized by simply changing the flexible shrouds.

Thus, a distributor or retailer may stock shrouds in a variety of colors and patterns so that customers may personalize the appearance of their machines.

Figure 3:
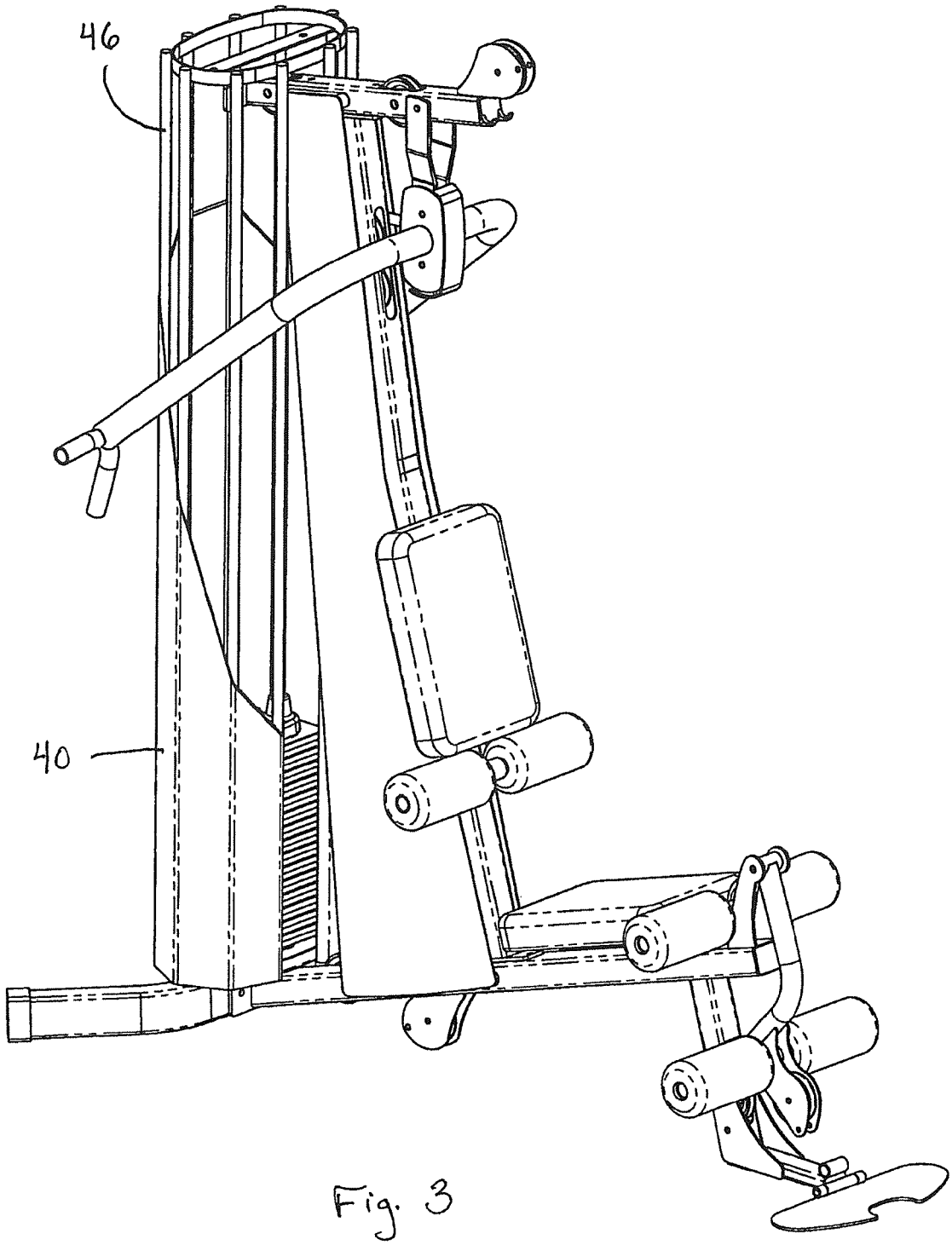
FIG. 3 illustrates an exercise machine with a flexible shroud in accordance with another embodiment of the present invention.

FIG. 3 illustrates a flexible shroud 40 attached to a framework 46. Such a framework may be used to provide additional support for the shroud and to shape it with three-dimensional contours.

Figure 4:
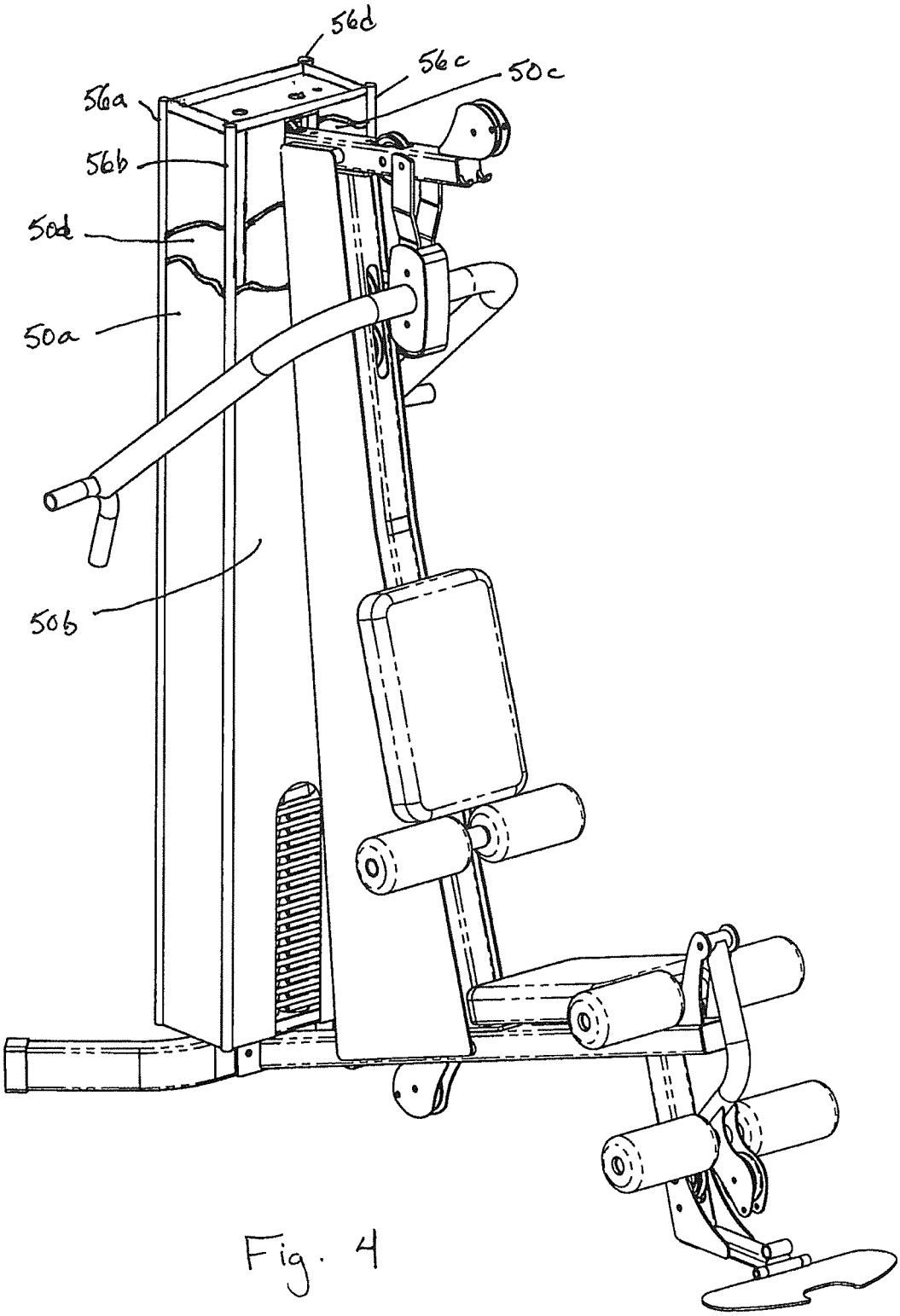
FIG. 4 illustrates an exercise machine with a flexible shroud in accordance with still another embodiment of the present invention.

FIG. 4 illustrates a flexible shroud 50 comprising four individual panels 50*a-d*.

Each of the panels is attached between a respective pair of vertical rods 56*a-d*. The panels may be attached along the entire length of the vertical rods, such as by hook and loop material, or may be attached at intervals by hook and loop material, snaps or other suitable fasteners. Shrouds comprising a plurality of panels allow even greater variety in the appearance of an exercise machine since the color and texture of each panel may be selected individually.

The present invention provides a light weight, quiet, low cost option for shrouds for weight stacks or other portions of an exercise machine to cover cables and pulleys, moving parts, or just to add cosmetics. Flexible materials such as screens and fabric are low cost, absorb rather than resonate sound, and can be folded to fit into a very small package. Many options can be offered such as see through screen versions and many different colors and patterns of fabric. For weight stack shrouds, the flexible material is attached to a frame around the weight stack, or stretched by contoured templates above and below the weight stack so it cannot be pushed out of shape enough to get caught in the weights and protects users' fingers from getting caught between the weights when coming together during exercise.

The flexible shroud takes the shape of the template or framework to which it is attached, offering low cost design cosmetics to exercise machines.

Exercise machines may have the templates and/or framework for the shrouds packed with the main box for the machine, and the flexible shroud may be packed separately in its own box or bag so optional colors or styles may easily be provided. Replacement shrouds are also less expensive because the template and/or framework is not replaced, just the flexible material.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An exercise apparatus comprising:
a support frame;
a template member attached to the support frame;
a flexible shroud attached to the template member so as to conform to a contour thereof; and
a weight stack;
wherein the flexible shroud at least partially surrounds the weight stack.

2. The exercise apparatus of claim 1 wherein the flexible shroud comprises a panel of limp material.

3. The exercise apparatus of claim 2 wherein the limp material is a fabric.

4. The exercise apparatus of claim 2 wherein the limp material is a see-through mesh.

5. The exercise apparatus of claim 1 wherein the template member is adjustably attached to the frame so as to place the flexible shroud under tension.

6. The exercise apparatus of claim 1 wherein the template member is disposed above the weight stack.

7. The exercise apparatus of claim 1 wherein the template member is disposed below the weight stack.

8. An exercise apparatus comprising:
a primary support frame;
a weight stack;
a secondary support frame arranged around the weight stack;
a flexible shroud attached to the secondary support frame so as to at least partially hide the weight stack from view.

9. The exercise apparatus of claim 8 wherein the flexible shroud comprises a panel of limp material.

10. The exercise apparatus of claim 9 wherein the limp material is a see-through mesh.

11. The exercise apparatus of claim 8 wherein the flexible shroud is wrapped around the secondary support frame.

12. The exercise apparatus of claim 8 wherein the flexible shroud comprises a plurality of panels.

13. An exercise apparatus comprising:
a support frame arranged in a three-dimensional shape;
a flexible shroud disposed on the support frame so as to conform to the three-dimensional shape; and
a weight stack;
wherein the flexible shroud at least partially surrounds the weight stack.

14. The exercise apparatus of claim 13 further comprising at least one moving part of the exercise apparatus and wherein the flexible shroud at least partially surrounds the moving part.

15. An exercise apparatus comprising:
a support frame arranged in a three-dimensional shape;
a flexible shroud disposed on the support frame so as to conform to the three-dimensional shape; and
a weight stack;
wherein the support frame at least partially surrounds the weight stack.

16. The exercise apparatus of claim 15 further comprising at least one moving part and wherein the support frame at least partially surrounds the moving part.

17. The exercise apparatus of claim 15 wherein the flexible shroud comprises a panel of limp material.

18. The exercise apparatus of claim 17 wherein the limp material is a fabric.

19. The exercise apparatus of claim 17 wherein the limp material is a see-through mesh.

20. The exercise apparatus of claim 13 wherein the flexible shroud comprises a panel of limp material.

21. The exercise apparatus of claim 20 wherein the limp material is a fabric.

22. The exercise apparatus of claim 20 wherein the limp material is a see-through mesh.

23. The exercise apparatus of claim 13 wherein the flexible shroud comprises a plurality of panels.

24. The exercise apparatus of claim 9 wherein the limp material is a fabric.

* * * * *